United States Patent [19]

Woestemeyer et al.

[11] Patent Number: 5,024,487

[45] Date of Patent: Jun. 18, 1991

[54] METHOD OF CREATING AN UNDERGROUND BATCH RETORT COMPLEX

[76] Inventors: Henry J. Woestemeyer, Vista del Rio #2202, 200 Colorado Ave., Parachute, Colo. 81635; Martha Oksuz, 1218 Carbide Court, Longmont, Colo. 80501

[21] Appl. No.: 471,426

[22] Filed: Jan. 29, 1990

[51] Int. Cl.[5] ..... E21B 41/10; C10B 53/06

[52] U.S. Cl. ..... 299/2; 166/256; 166/259; 299/18

[58] Field of Search ..... 299/2, 18; 166/259, 166/260, 256

[56] References Cited

U.S. PATENT DOCUMENTS

| | | | |
|---|---|---|---|
| 1,447,297 | 3/1923 | Day | 202/107 |
| 2,630,306 | 3/1953 | Evans | 209/2 |
| 3,407,003 | 10/1968 | Durie | 299/4 |
| 3,652,447 | 3/1972 | Yant | 208/402 |
| 4,025,416 | 5/1977 | Deering et al. | 208/407 |
| 4,094,769 | 6/1978 | Brown | 208/426 |
| 4,135,579 | 1/1979 | Rowland et al. | 208/402 X |
| 4,243,510 | 1/1981 | Dhondt | 208/407 |
| 4,266,826 | 5/1981 | French | 166/259 X |
| 4,376,033 | 3/1983 | Calderon | 208/402 |
| 4,379,593 | 4/1983 | Weichman | 299/2 |
| 4,447,090 | 5/1984 | Knepper | 299/2 |
| 4,505,516 | 3/1985 | Shelton | 208/401 X |
| 4,552,214 | 11/1985 | Forgac et al. | 166/260 X |
| 4,577,908 | 3/1986 | McKee et al. | 299/2 |

*Primary Examiner*—Ramon S. Britts

*Assistant Examiner*—David J. Bagnell

[57] ABSTRACT

Complexes of underground batch retorts, designed to duplicate surface retort prototypes proven successful in use, which may extend for miles on branch drifts intersecting central main drifts above and below the retorts, the main drifts emerging at surface. The batch retorts are very large, deep, planned mine cavities, with relatively small upper and lower openings, remaining after shale oil ore has been extracted by vertical crater retreat stoping and free-fall controlled at the bottom opening. Resort openings are sealed after they have served their purposes, which enables the symmetrical progression of the upper and lower branch drifts along which the retorts are mined. The drifts provide access to blasting sites, conveyors for removing fragmented ore to be crushed and screened, and conveyors for returning processed ore to the retorts. Loading is accomplished through a retracting device which deposits processed ore with minimal free-fall, to avoid creating fines in the loading process. Sealing of the retorts converts them into conventional batch retorts, infinitely more efficient in product recovery than in situ retorts and providing a cleaner product. One-time use of retorts, using protracted retorting periods, enables control of temperature by controlling the amount of air-flow through the retorts. Spent shale remains in the sealed retorts following pyrolysis, eliminating the need for disposal and supporting the walls of the retort. Ore processing and recovery operations can be situated at surface, or can be advantageously housed underground, at sizeable savings in plant and transportation costs.

1 Claim, 4 Drawing Sheets

METHOD OF CREATING AN UNDERGROUND BATCH RETORT COMPLEX

FIELD OF THE INVENTION

This, invention relates to the structure and/or arrangement of an opening into the earth which is utilized to recover shale oil and flammable gases from oil shale.

DESCRIPTION OF THE PRIOR ART

The art of pyrolyzing oil shale for the recovery of shale oil has been practiced for many years. Many countries have deposits of oil shale, and have used many methods of pyrolyzing the shale.

Most of the methods used have been surface retorting techniques. Among these methods has been used of the "batch retort," known by this terminology in the oil shale industry and, to date, constructed only at ground surface. A batch retort may be defined as follows: "A semiclosed vessel with small openings at two ends to permit the introduction of a heating agent at one end and the eduction of flammable gases and shale oil at the other end when oil shale has been pyrolyzed within the body of the vessel. The Nevada-Texas-Utah (N.T.U.) batch-type retorts demonstrated by the United States Bureau of Mines at Anvil Points, Colo. were of a semi-works size, and were quite successful in producing shale oil.

Many companies have developed flow-through retorts, in which the shale is fed into the retort and is pyrolyzed as it flows through the retort. After the oil is extracted from the gases produced by pyrolysis, the spent shale flows through and out of the retort.

One of the first of the flow-through retorts was the gas-combustion retort developed and demonstrated by the U.S. Bureau of Mines at Anvil Points, Colo. This retort was quite successful. Most of the more recent flow-through retorts followed the principle of the U.S. Bureau of Mines gas-combustion retort, using various modifications of gas and air flow through the retort.

The most successful gas-flow retorts were those operated by Mobil Oil and five associated companies, and the Paraho retort operated by a consortium of seventeen maJor oil companies at Anvil Points, Colo. These retorts were built upon the site originally used by the U.S. Bureau of Mines at Anvil Points, Colo., where the gas-combustion retort had been demonstrated.

An upside-down retort, in operation at this time, was developed by Union Oil Company, or Unocal. This is a flow-through retort with the shale loaded onto a hydraulic ram which pushes the shale upwards through the retort, pyrolysis occurring as the shale moves upward through the retort, rather than downward through the retort as in the gas-combustion Mobil Oil and Paraho retorts.

Several in-situ retorts have been developed by major oil companies. In the in-situ method the shale is broken by blasting underground, rubbleizing the shale. None of these has been successful. It is necessary that air and gases flow through the shale bed during retorting. In the case of rubbleized shale, there is no place for air and gases to go, as the fines stay in the shale bed. Combustion air and gas flow are blocked to such an extent that total pyrolysis of the shale has been impossible.

Two major disadvantages accrue from surface retorting. One disadvantage is that it would cost billions of dollars to build the number of retorts necessary for extensive retorting. The other major disadvantage is that after the shale is retorted disposal must be made of the spent shale. Many mountains of shale will arise as a result of this disposal, with great environmental impact and at extreme cost in transporting and stockpiling the spent shale.

Vast amounts of water will be required in surface retorting to cool the retorted shale enough to meet environmental standards. The water will leach out undesirable salts from the spent shale, and run-off water will require much treatment to meet environmental standards.

The University of Wyoming, at Laramie, under the auspices of the U.S. Bureau of Mines, spent many years attempting to find some use, commercial or otherwise, for spent shale. Oil companies have attempted to place the shale back underground, even forming it into blocks which could be stacked in the empty mines. The in-situ retort has been attempted by several oil companies. All of these attempts have been failures.

During the many years in which the U.S. Government, many oil companies, and others, have retorted oil shale, the great nemesis, and the long-felt unsolved need, has been some way to dispose of the spent shale which remains after the shale has been pyrolyzed. The apparently unobvious method which we have developed and for which we now seek a patent presents a solution which not only disposes of the shale in a cavity remaining after the marlstone has been mined out, but also satisfies the environmental need to leave the surface practically undisturbed.

The present invention is a complex of underground batch retorts utilizing mine cavities from which oil shale has been extracted according to design, together with necessary appurtenances, as batch retorts in which crushed and screened oil shale is pyrolyzed for the recovery of shale oil and flammable gases. This invention will operate almost exactly as did the N.T.U. retorts demonstrated by the U.S. Bureau of Mines at Anvil Points, Colo.

The N.T.U. retorts were steel shells, approximately twelve feet in diameter and twenty-three feet high. The shells were mounted on a steel framework about twenty feet from the ground. A sloping steel chute was framed directly below each shell for removal of the spent shale after retorting.

Each shell had a hinged steel cover over the shell. Each shell had a hinged steel cover under the shell which was operated by a hydraulic ram to enable the operator to raise and lower the cover, which was quite heavy when loaded with shale.

To operate the N.T.U. retort, the upper cover was raised and the retort was loaded with crushed and screened shale to a top level about two feet from the top of the shell. The shale was then covered with broken boards. The top of the retort was then closed, and an operator lit the boards, working through a hatch in the cover of the retort.

After lighting the boards, combustion air was forced into the top of the retort through a large pipe connected to the top of the shell, just under the cover and above the shale bed. As combustion air increased, the kerogens in the shale would begin to burn. Very quickly the shale below the combustion would begin to pyrolyze, as the combustion air and burned gases heated the shale below the combustion to 800° F. or higher. The slightly destructive burning of the kerogens to start the retort would cease, and free carbon remaining on the shale after pyrolysis began would now burn as combustion air was blown down through the shale.

The exhaust gases released from the shale were drawn away from the retort through a pipe located at the bottom of the retort After pyrolysis had been completed, and the carbon had burned off the spent shale in the retort, the combustion air and the suction blower were shut off.

Now, the hatch at the top of the retort was opened to admit air during the dumping of the spent shale. Then the bottom was opened by the hydraulic ram and the shale was dumped on the sloping chute below the retort where it was carried out to an open space beyond the retort.

After the red-hot shale was dumped, operators sprayed water on the pile of shale until it was cooled. Next, a bulldozer was brought in and dozed the shale away and over to the bank of a canyon where it was dumped, its final disposition.

These retorts were successful and efficient.

However, it can be easily seen that dumping the shale, cooling the shale with water, and bulldozing the shale away and into the canyon was quite costly and used a large quantity of water. Very quickly the canyon would be full of spent shale, which created an environmental impact because of the leaching of harmful salts from the spent shale which would run off down the canyon to the Colorado River.

The above background will be very helpful in understanding the operation of the retort in this invention.

SUMMARY OF THE INVENTION

Objects

To provide a method for producing shale oil that is economically feasible, i.e., to produce crude oil at a price lower than or competitive with imported crude oil.

To make timely, conservative, and efficient use of an abundant resource in order to relieve U.S. dependence on foreign oil, to reduce the U.S. trade imbalance, and to revitalize the Colorado economy.

Advantages

Use of underground batch retorts will conserve oil shale land, in that it is a more efficient system than in-situ retorting, and will nullify the need to expend many billions of dollars on the construction of surface retorts.

The one-time use of underground batch retorts will make possible an operation free of down-time for turnarounds or retort breakdowns, and will greatly minimize maintenance needs.

While variations could be made to both the design and peripheral dimensions set forth in the drawings accompanying this invention, there are reasons for them. A note follows which will enable the reader to understand the reasons for and advantages of the design and peripheral dimensions of the mine-retort as specified in the drawings, both of which are extremely advantageous from the standpoint of obtaining the maximum volume that can be obtained safely and retorted successfully.

Note: Beginning in 1945 the U.S. Bureau of Mines, at Anvil Points, Colo., made many tests to determine how many feet of oil shale could be removed before the overburden would cause the back of a mine to fall. These tests determined that a span of fifty feet could be mined out in the width of a mine, for an undetermined length, probably hundreds of feet.

The above tests were made by driving a peg into the back of the mine and another peg directly below the first peg, in order that micrometer measurements could be made. Tests were made for many months, and when drifts were widened more months of testing ensued. There were no signs of back collapse at fifty feet in width. At sixty feet in width the back began to lower, and a collapse eventually occurred.

Mines-retorts can be shortened or lengthened according to the depth of high grade shale ore encountered as mining progresses; however, changes will need to be made gradually, so that conveyor belts in the lower branch drifts do not incline too steeply.

The design of the mine makes possible the use of vertical crater retreat (VCR) stoping to excavate nearly all of the ore. It is this which makes mining of the ore commercially feasible. The two twenty-foot wide accesses to the mine which serve as ore passes extending to the bottom of the mine. culminating in truncated pyramids with openings ten feet square. can be VCR-stoped.

The top ten feet of the mine surrounding the ore pass will need to be excavated by conventional means, as will the chutes leading from the bottom of the truncated pyramid into the branch drifts. The remainder of the mine will be excavated in stages, by VCR stoping, and the ore will fall out for loading, a very inexpensive means of excavating a mine and creating a batch retort.

Using shale that has been crushed and screened to assure appropriate size, with exclusion of fines from the retort, offers a method which has been very successfully practiced in both the Nevada-Texas-Utah (N.T.U.) batch retorts and in continuous-feed retorts.

A very acute advantage will exist in the fact that most operations will be underground, with moderate temperatures and exacting ventilation control, avoiding severe changes in weather which exert hardships on the operation of above-ground retorts. This will make feasible continuous operation, enabling the operator to maintain a steady workforce, and this, in turn, will enable the operator to make a rapid return of investment.

The most critical advantage in underground retorting arises from the fact that all spent shale will remain in place underground after retorting. There will be no handling of the spent shale, and there will be no environmental impact. The foregoing compares to moving the spent shale and stockpiling mountains of it at surface, with severe environmental impact, when oil is retorted at surface.

After pyrolysis has been completed in the underground batch retort, air and/or air and burned recycle gas can be blown through the spent shale to reduce its temperature to any desired level.

After surface retorting, the vast water problem, using water to cool the spent shale, is a costly matter required by the Environmental Protection Agency. After cooling the shale with water, costly treatment of run-off water is necessary to eliminate salts leached out of the spent shale. None of the water problems associated with surface retorting, outlined above, will exist in the use of this underground retorting system.

Crushed and screened oil shale occupies more space than unmined shale, so that approximately one-fourth of the shale mined out cannot be returned to the retort, and will be deposited at surface. This will enable operators to select by assay the shale to be retorted. The mined-out shale at surface will be a pure marlstone, identical to that which has been exposed in the oil shale cliffs for many centuries, and will have no impact on the environment.

Thousands of underground retorts, with far greater capacity than has heretofore been thought feasible, or even imagined, may be added along the branch drifts extending from the main drifts in the oil shale strata, extending to the farthest reaches of owned or leased oil shale properties.

The only necessary surface disturbances related to the underground retorting system will be the construction of a building for the air compressors and ventilation blowers, office buildings, parking lots for workers, maintenance facilities, and possibly a laboratory. While crushing and screening facilities and recovery operations could be housed at surface, there would be much advantage and sizeable savings in plant and transportation costs to be obtained from housing them underground.

When mining has commenced, there will also be stockpiles for the mined shale that cannot be accommodated in the retorts, and for the fines screened from the crushed oil shale, neither of which constitutes an environmental hazard. Extra mined ore could be processed and sold to a customer crushed and screened, or sold as is.

The gates and retractable loading pipe are moved from mine-retort to mine-retort for reuse. Branch conveyor belts can be moved for reuse as mining progresses.

Means are provided for loading the batch retort with crushed and screened oil shale, loading continuously through two telescoping chutes that are raised as loading progresses so that the crushed and screened oil shale does not fall far, keeping the oil shale particles intact and avoiding the creation of fines and dust in the loading process.

In summary, many years of research and experimentation have resulted in a very successful method of extracting oil from oil shale: the pyrolysis of crushed and screened oil shale in batch retorts. To date this has not been attempted on a commercial scale because of attendant financial and environmental problems. This invention solves both of these problems, in that:

1) The ore must be mined in order to process it for retorting; mining the ore as specified in this invention makes mining cost commercially feasible, and mining it according to the design and peripheral dimensions specified makes possible the use of the mine cavity as a batch retort of ample dimensions to make batch retorting commercially feasible.

2) Advantages environmentally are that the spent shale remains in place, underground, requiring no further handling, and providing support for the walls within and surrounding the retort. This negates the necessity to use huge quantities of water, scarce in the area where the shale is located, to cool the spent shale, and thus also eliminates the need to treat water used for this purpose.

DETAILED DESCRIPTION OF THE DRAWINGS

Figure 1:
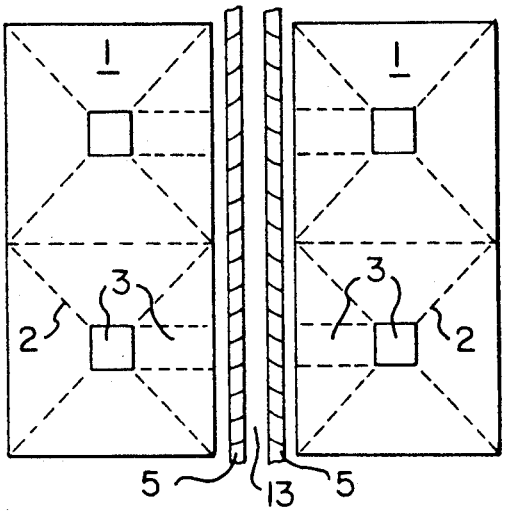
FIG. 1 depicts schematically a plan view, looking downward through two opposing retorts with lower chutes feeding onto conveyor belts in a shared lwoer branch drift.

FIG. 1. depicts a view looking downward through a mine 1 cavity from the top of the mine 1 to the truncated pyramid 2 at the bottom of the mine 1, showing the corners of the truncated pyramid 2, and ore chutes 3 for transferring the shale, as it is mined out, to lower branch conveyor belts 5 in lower branch drift 13.

Figure 2:
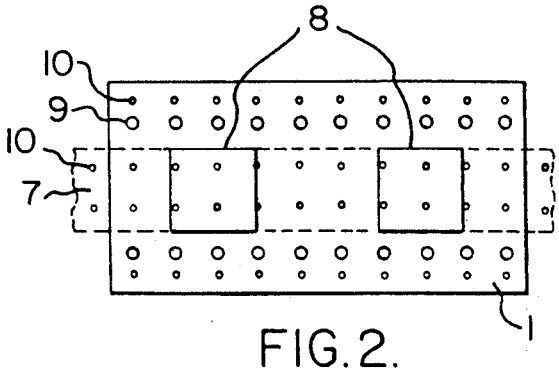
FIG. 2 is a roof or back view of a retort depicting the lower ore chutes and the roof bolting system.

FIG. 2. is a horizontal view depicting the roof, or back, of a mine 1, showing long roof bolts 9 and short roof bolts 10 installed to prevent subsidence of the roof because of the overburden above mine 1, upper branch drift 7, and entrances to mine 8.

Figure 3:
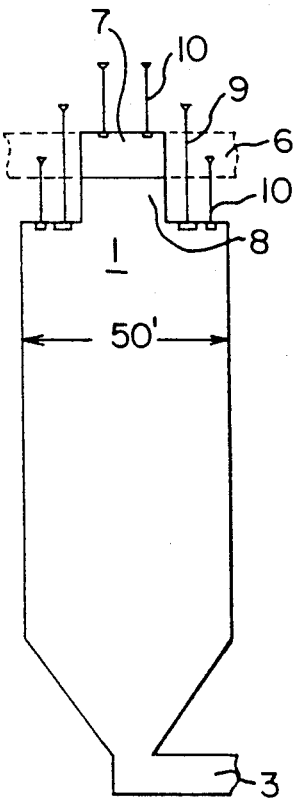
FIG. 3 is a vertical view of a retort depicting the lower ore chutes and the roof bolting system.

FIG. 3. depicts a vertical view of a mine 1, showing upper branch drift 7 connected at a right angle to upper main drift 6, mine entrance 8 to the mine 1, long roof bolts 9 and short roof bolts 10 used to sustain the roof, and ore chute 3 at the bottom of the mine 1. The fifty foot dimension shown for the width of the mine 1 is the only critical dimension of the mines 1, and should not be exceeded, other dimensions of the mine(s) 1 could vary from those indicated by the drawings.

Figure 4:
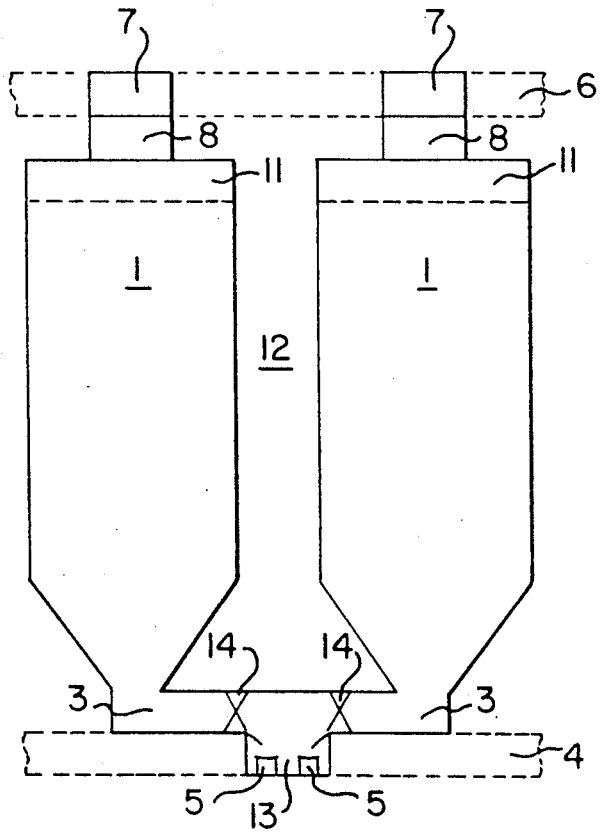
FIG. 4 depicts schematically two retorts on opposite sides of a lower branch drift, showing conveyor belts and gates in the ore chutes, and depicting upper branch drifts with openings into the top of the retort, and mining space below the openings.

FIG. 4. depicts two mines 1 in vertical view, showing upper branch drifts 7, connected at right angles to upper main drift 6, mine entrances 8, mining spaces 11 to enable miners to drill the main shale body of the mines 1, the wall 12 between the two mines 1 to sustain the overburden, ore chutes 3 to direct mined shale through gates 14 to load branch conveyor belts 5 in lower branch drift 13.

Figure 5:
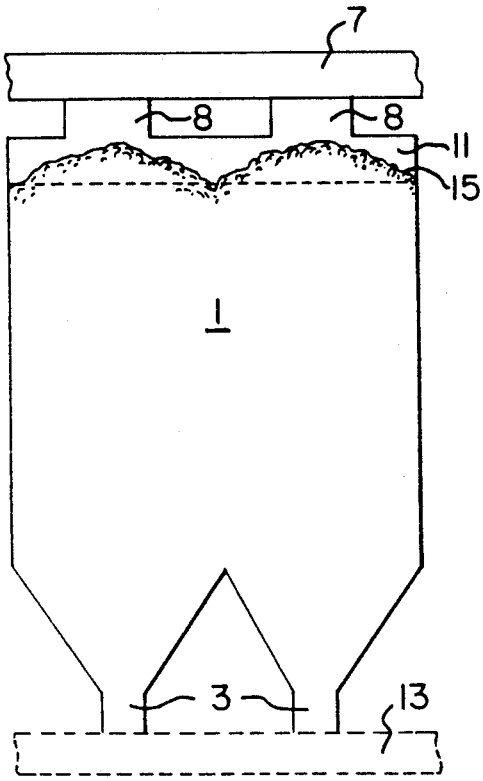
FIG. 5 is a vertical view of a retort shown with two ore chutes and loaded with crushed and screened oil shale, depicting the crowned shape of the shale body.

FIG. 5. depicts a retort 1 rotated 90 degrees from that shown in FIG. 3, showing branch drift 7, mine entrance 8 above retort 1, mining space 11, and the load contour 15 that will obtain when the retort 1 is filled with shale. Also shown are the ore chutes 3 viewed from this angle, each leading to lower branch drift 13.

Figure 6:
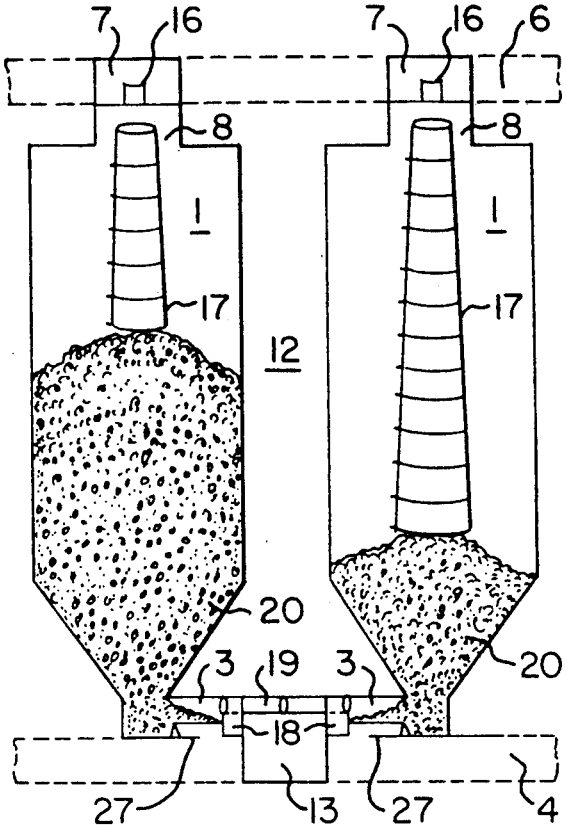
FIG. 6 is a vertical view fo two reports partially loaded with shale, showing the retractable shale loading pipe beneath belt conveyors.

FIG. 6. depicts two retorts 1 rotated 90 degrees from that shown in FIG. 5., showing upper branch drifts 7 connected at right angles to upper main drift 6, upper branch conveyor belts 16, entrances to retorts 8, retractable loading pipes 17 through which shale is lowered into the retorts 1, and crushed and screened loaded shale 20 in partially loaded retorts 1. FIG. 6 also depicts ore chutes 3, concrete lower retort seals 18, suction gas pipe 19, extending through concrete lower seals 18, to extract gases from the retorts 1, shields for oil drop out pipes 27 which are installed prior to installation of concrete lower retort seals 18, and lower branch drift 13 connected at a right angle to lower main drift 4.

Figure 7:
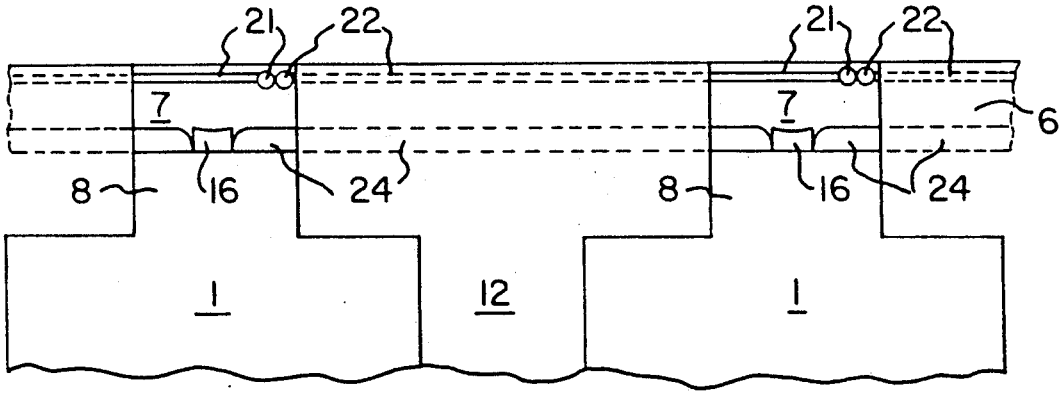
FIG. 7 is an expanded view of the top of two retorts showing conveyor belts, ventilation pipes, and compressed air pipes, traversing through the drifts.

FIG. 7. is an expanded view depicting the upper portion of two retorts 1 separated by wall 12, showing upper branch drifts 7 connected at right angles to upper main drift 6, mine entrances 8, upper branch conveyor belts 16 in upper branch drifts 7, ventilation pipe 21 and compressed air pipe 22 which come from ground surface through upper main drift 6 and upper branch drifts 7 to retorts 1, upper main drift conveyor belt 24 in upper main drift 6 connected at right angles to upper branch conveyor belts 16 in upper branch drifts 7.

Figure 8:
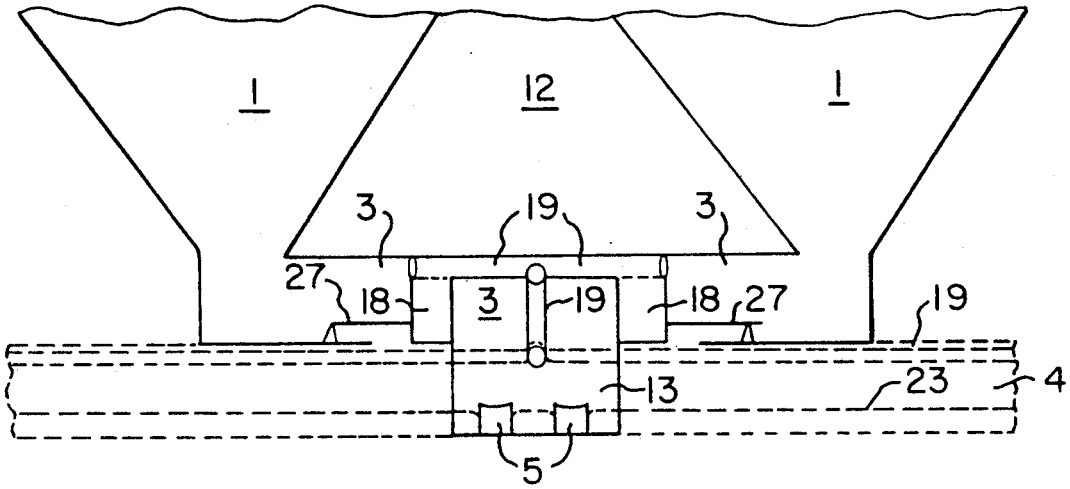
FIG. 8 is an expanded view of the bottom of two retorts showing shields for oil dropout pipes and the route of exhaust gas pipes from the retort.

FIG. 8. is an expanded view depicting the lower portion of two retorts 1 with wall 12 between the two retorts 1, showing ore chutes 3 capped by concrete lower retort seals 18, at the top of which suction gas pipe 19 is embedded and extended into the ore chutes 3 as means of drawing gases to a recovery system. Also shown are shields for oil drop out pipe 27, which are installed before the retorts 1 are sealed. Lower branch drift 13 connected at a right angle to lower main drift 4 is shown, with lower branch conveyor belts 5 and lower main drift conveyor belt 23.

Figure 9:
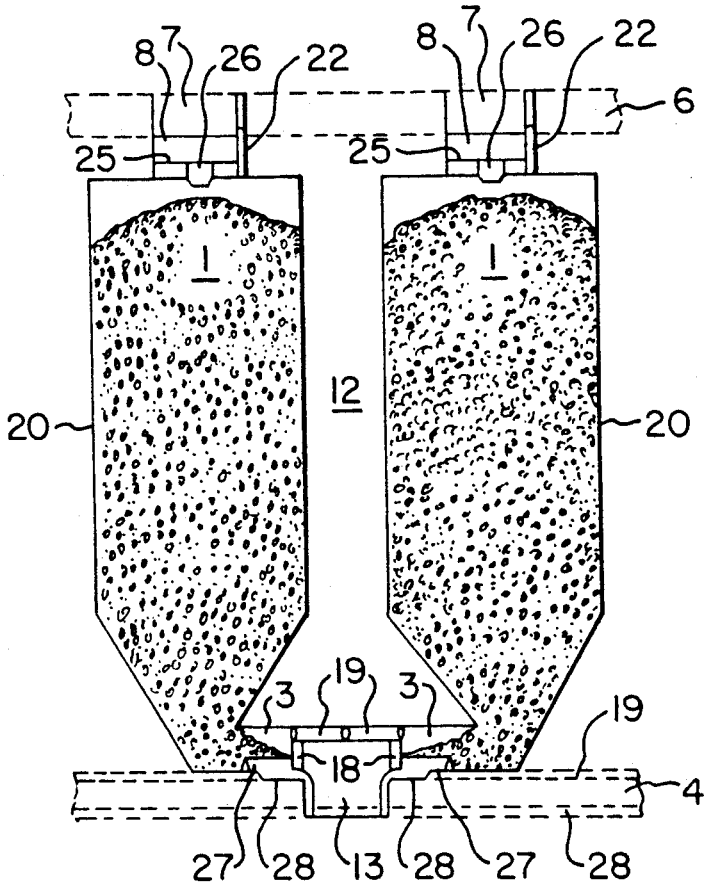
FIG. 9 is a vertical view of two retorts loaded with shale ore, with upper and lower gas-tight seals in place, and showing the route of oil dropout pipes extending through the seals.

FIG. 9. depicts two retorts 1 that share a common lower branch drift 13 filled with crushed and screened loaded shale 20, ready for heating and pyrolysis of the shale. Shown is wall 12 separating the two retorts 1 to retain the overburden above the retorts 1, upper branch drifts 7 connected at right angles to upper main drift 6, and retort entrances 8. FIG. 9 depicts concrete upper retort seals 25, with observation windows 26 embedded in and through the concrete upper retort seals 25 to enable operators to observe the retorting process, and compressed air pipes 22 extended through concrete upper retort seals 25 into retorts 1. FIG. 9 depicts also lower branch drift 13 connected at a right angle to lower main drift 4, ore chutes 3, concrete lower retort seals 18, suction gas pipe 19 which extends through lower branch drift 13 and lower main drift 4 to a recovery system, and shields for oil drop out pipe 27, attached to oil drop out pipe 28 which runs through lower branch drift 13 and main drift 4 to a recovery system.

Figure 10:
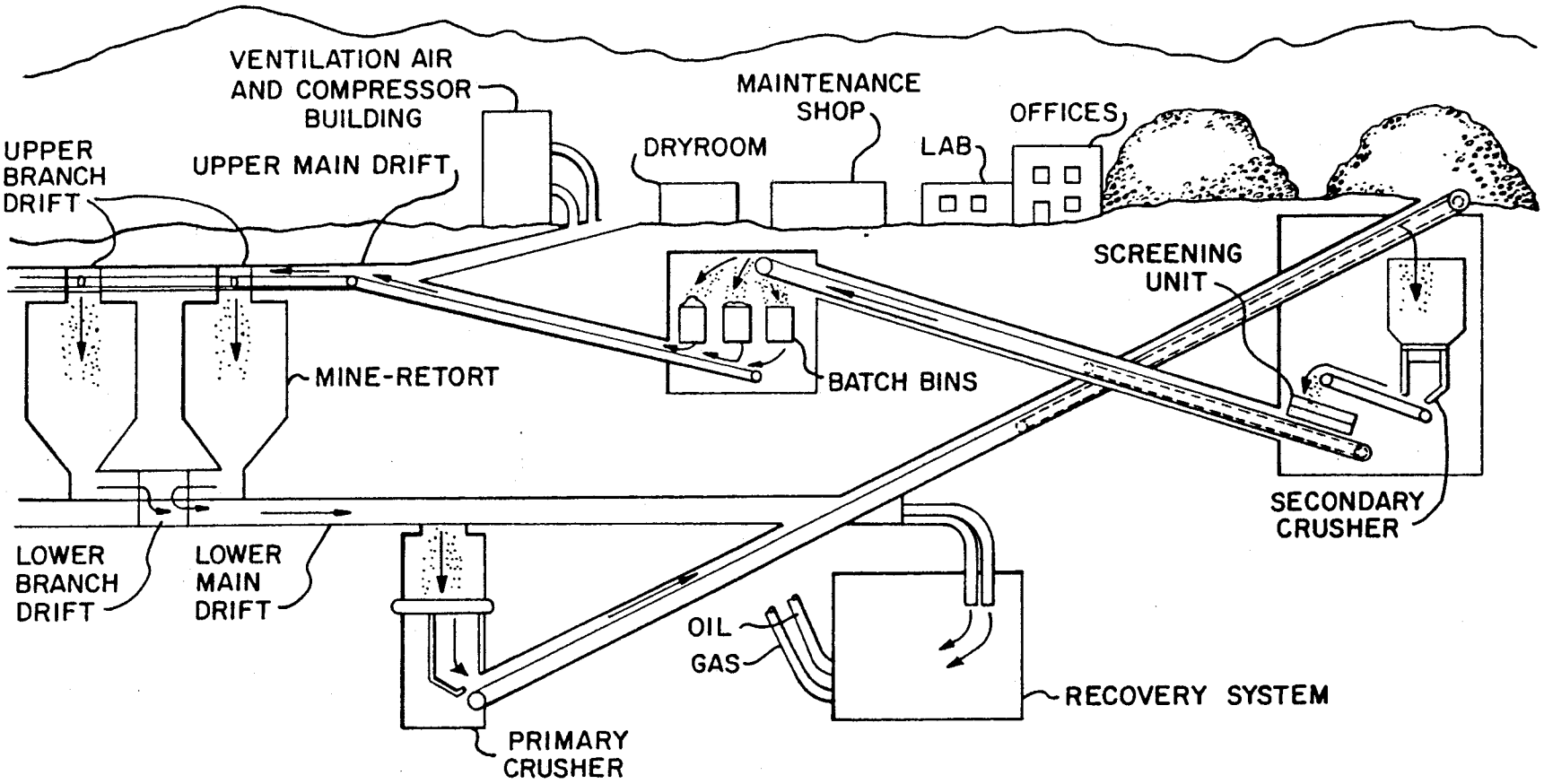
FIG. 10 is a flow sheet depicting the route of the mined oil shale from the mines through a primary crusher, secondary crusher, screening unit, and return to the retorts.

FIG. 10. is a flow sheet depicting the route of the mined oil shale from the mines through a primary crusher, secondary crusher, screening unit, and return to the retorts.

This invention relates to pyrolysis of oil shale in underground batch retorts 1, using mine 1 cavities remaining after the original oil shale has been mined out, loaded with crushed and screened oil shale 20, all fines having been removed, as the batch retorts 1 in which pyrolysis will be effected.

The retorts 1, according to tests made at Anvil Points, Colo., should not be more than fifty feet in one direction of their area, see FIG. 3., may be any length that an operator desires in the other direction, and the depth will be dictated by the assay value of the oil shale.

The crushed and screened oil shale 20 should be fed into the retorts 1 in such manner that the shale does not fall a sufficient distance to produce fines in the loading process, and this can be accomplished by a telescoping, retractable loading pipe 17, as shown in FIG. 6.

The original oil shale that is excavated should be reduced to rubble sufficiently sized to permit free flow through the ore chute 3 appended to the truncated pyramid 2 that forms the bottom of the retort 1.

Heating of the shale for pyrolysis may be done by any of the methods well known in the art of retorting, burning of the carbon on the spent shale being favored so that flammable gases can be saved for use at surface.

The retort 1 is loaded with crushed and screened oil shale, with all fines removed, for pyrolysis at a temperature range between 800° F. and 1100° F.

To start pyrolysis, the shale must be heated at the top of the shale bed. Several means of heating the shale to the temperature of pyrolysis have been used in surface mounted retorts. One of the most promising methods, that might be used in heating of the first retort 1, is to heat air and exhaust gases to 1000° F. by burning propane in a furnace and forcing these 1000° F. gases into and through the shale bed to heat the upper surface of the shale bed to a temperature range of 800° F. to 1000° F. After the shale at the top of the shale bed reaches 800° F., pyrolysis of the oil shale below the top of the bed will begin, the gases being drawn through the shale bed by means of a suction gas pipe 19 at the bottom of the retort 1 and drawn off at the bottom of the shale bed through the suction gas pipe 19 to be delivered to a recovery system for recovery of shale oil. As pyrolysis begins, free carbon remains on the shale. With fresh compressed air blown over the shale bed through compressed air pipe 22, the free carbon will ignite and provide the necessary heat for pyrolysis of the remaining shale in the shale bed.

As the first retort 1 is being pyrolyzed, other retorts 1 may be ignited by using the flammable gases, remaining after shale oil has been removed in the recovery procedure, from the first retort 1, and later from successive retorts 1. The retorting process will require no further use of propane gas. Other methods of firing off the retort have been used, and are so well known in the art of retorting that they need no mention here.

The length of time required for fully retorting the shale in any one retort 1 will be determined by the operator, and will vary according to the wishes of different operators. Time is not of the essence in retorting in the underground batch retort 1 as it is in a surface mounted flow-through retort. Control of flame temperature is vital, as carbonates in the shale will melt at about 1600° F. and will compact in the bed to prohibit the flow of gases through the retort 1. Control of temperature in the retorting process by recycling gases mixed with air through the retort is well known in the art of retorting, and need not be explained here.

Suction is placed on the bottom of the retort through suction gas pipe 19 as pyrolysis begins, to remove the gases and shale oil mists from the retort 1 and blow them through the recovery system.

As pyrolysis gets to a lower level in the retort, temperature of the gases will rise. When the gases reach a temperature above the distillation temperature of the kerogen, the gases must be condensed before recovery of shale oil is possible. The art is well known in the industry.

The gases remaining after recovery of shale oil are inflammable, and are of much value at surface, for making steam, etc. These gases could be burned to provide heat for pyrolysis in the retort 1; however, their value at surface would be lost, as would the value of the unused carbon remaining on the spent shale.

The load contour 15 of the crushed and screened shale at the top of the retort, shown in FIG. 5., is designed to furnish an approximately even travel of gases through the shale bed to secure even burning of carbon through the shale bed while retorting.

As different operators will possibly vary the size of the retorts 1 and the time schedule for operation, the amount of compressed air and suction gas must be calculated for each operation.

The operation of these underground batch retorts 1 will be so similar to the operation of the Government's N.T.U. retorts that the data for operation of these N.T.U. retorts will serve as an invaluable aid in the operation of the underground batch retorts 1.

Each of the batch retorts in an underground batch retort complex is a reproduction on a very large and thus commercially feasible scale of the semi-works size, experimental, N.T.U. surface retorts, actually constructed and proven successful in use, that have preceded this invention. Any one of these minecavity batch retorts, mined according to the specifications outlined in this invention, will constitute a batch retort immensely larger than any batch retort heretofore manufactured, or even envisioned.

The design of the retort, achieved in the mining process, makes possible the sealing of the upper and lower openings into the retort, transforming the mine cavity into a conventional batch retort, and because the retort is for one time use and retorting time is not of the essence, makes possible control of the temperature at which the shale ore is pyrolyzed.

Spent shale resulting from pyrolysis remains in the sealed batch retort, eliminating the need for disposal, and providing support for the walls of the batch retort.

The sealed batch retort also enables the extension of the upper branch drifts centered directly above the retorts and the lower branch drift centered in the wall that will separate each set of two rows of batch retorts, so that one lower branch drift suffices to serve two rows of retorts, making possible the creation of additional batch retorts along the branch drifts in straight continuum, thus maximizing productivity from the oil shale field in which the retort complex is situated.

On a typical government oil lease of 5,120 acres (two miles wide and four miles long), more than 26,000 batch retorts as described in the specification can be pyrolyzed. The oil shale stratum covers such vast expanses of land in the western United States that several hundreds of thousands of in situ batch retort complexes could be profitably established there.

To process oil shale ore for pyrolysis in a batch retort, the ore must be mined; thus the underground batch retort is obtained very inexpensively. In addition, the gates used to control the flow of mined ore onto a conveyor belt and the retractable loading pipe with which the retort is loaded with processed ore are portable, moved from one mine and retort to others for reuse, and branch conveyor belts can be moved for reuse as mining progresses.

While the invention is described in a preferred embodiment, it is not intended to limit the scope of the invention to the particular form set forth, but, on the contrary, it is intended to cover such alternatives, modifications, and equivalents as may be included within the scope of the invention as defined by the appended claim.

We claim as our invention:

1. A method for creating an underground complex of sealed batch retorts, said sealed batch retorts to be utilized for the pyrolysis of processed oil shale ore therein, comprising the steps of:

(a) establishing sites and levels underground for upper and lower main drifts, following the same course one above the other, to be centrally located across a land-holding in oil shale stratum that will be mined to become a complex of underground batch retorts, these main drifts to serve as access to and egress from the mine workings, and extending these drifts to the site of the first of a plurality of branch drifts that will intersect the main drifts at right angles and extend in both directions from the main drifts to the boundaries of the planned complex of batch retorts, an upper branch drift to be centered in the lengthwise direction over a planned row of deep rectangular stopes that will extend to the level of a lower branch drift, and the lower branch drift centered in a wall that will divide the planned row of stopes from a second row of stopes to be established parallel to the first row of stopes centered along a second upper branch drift;

(b) extending said upper and lower branch drifts the length of the first of a plurality of rectangular stopes to be mined between the upper branch drift and the lower branch drift, and installing roof bolts in the roof of the upper branch drift to sustain the overburden;

(c) plotting the center of each lengthwise half of the planned rectangular stope at the bottom level, bearing in mind that the width of the rectangular stope will not be more than fifty feet, dividing the length of the planned stope by two, and excavating two ore chutes approximately ten foot square extending in a straight line above the floor of the lower branch drift to the center of the lower extremity of each half of the planned stope, then installing portable gates between the ore chutes and the lower branch drift;

(d) determining two centers of the rectangular stope in the upper branch drift, plotting as in (c), above, and creating by vertical crater retreat (VCR) stoping two centered ore passes, approximately ten feet square, from the centers established in the branch drift into the centered first ten square feet of the ore chutes that extend into the lower branch drift, then expanding the first ten square feet of the ore pass to the width of the branch drift, approximately twenty square feet, disposing of the mined ore through the ore pass;

(e) excavating by conventional means the top of the planned rectangular stope, to create work space, beginning excavation below the floor of the upper branch drift, disposing of the mined ore through the ore passes, and installing roof bolts in the roof of the mined work space to sustain the overburden;

(f) creating the planned stope by the VCR stoping method, drilling from the mined work space created in (e), above, to create vertical walls approximately three-quarters of the distance from the top to the bottom of the stope, then gradually increasing the length of blasting holes in each half of the planned stope to shape a chute that is an inverted, truncated pyramid converging on the horizontal ore chute created in (c), above;

(g) loading the blasting holes with an explosive charge and blasting the drilled stope, in stages from bottom to top, to fragment the ore in the stope and remove it by fallout, and transporting the fragmented ore through the lower branch drift and the lower main drift to be crushed and screened in order to obtain particles of an optimum size for retorting, and, if desired, to be graded and batched according to assay;

(h) removing the portable gates from between the ore chutes and the lower branch drift, placing oil dropout pipes in the bottom of the emptied ore chutes, these oil dropout pipes to extend from the ore chutes through the lower branch drift and the lower main drift to a recovery system, shielding the portion of the oil dropout pipes within the ore chutes to protect them from the entry of shale ore when the stope is loaded for retorting, and installing a suction gas pipe centered between the ore chutes and extending into each half of the stope through the tops of the ore chutes, then sealing the bottom openings of the stopes at the lip of each of the ore chutes, sealing around the pipes which have been installed;

(i) loading the stope with crushed and screened shale ore through openings at the top of the stope, using portable, retractable loading pipes to effect loading in order to minimize free-fall and production of fines in the loading process, and loading shale ore to near the top of the entry into the stope, but leaving the shale bed at the top of each half of the stope rounded off, as it will fall from the loading device, to a depth of approximately ten feet in the center and around the outer peripheries of the stope to produce a cone-shaped shale bed in each half of the stope;

(j) inserting pipes that will bring compressed air from a surface source through the drifts into the upper portion of each half of the stope;

(k) sealing both openings into the stope at roof level, sealing around the compressed air pipes, at this point converting the stope to a batch retort wherein the temperature for pyrolysis can be controlled, and embedding in the seals observation hatches with an opening through which very hot air and exhaust gases, heated in a furnace by propane gas, or by other means, may be introduced into the top of the stope to ignite the shale bed;

(l) repeating the above steps at subsequent retort sites, leaving separating walls between stopes, extending branch drifts to both sides of the main drifts to accommodate additional stopes extending to the boundaries of the planned complex of underground batch retorts, extending main drifts to accommodate additional branch drifts to the end of the planned complex, situating ore chutes that share a branch drift so that the chutes from each side of the shared drift are facing, and omitting the necessity to heat air and exhaust gases to ignite the shale bed, as succeeding batch retorts may be ignited by using the flammable gases remaining after shale oil has been removed in the recovery procedure from the first batch retort, and later from successive retorts.

* * * * *

UNITED STATES PATENT AND TRADEMARK OFFICE

CERTIFICATE OF CORRECTION

PATENT NO. : 5,024,487

DATED : June 18, 1991

INVENTOR(S) : Henry J. Woestemeyer and Martha Oksuz

It is certified that error appears in the above-identified patent and that said Letters Patent is hereby corrected as shown below:

| | | |
|---|---|---|
| Title Page Item 57, ABSTRACT | Line 10 | 'Resort' should read --Retort-- |

| Column | Line | |
|---|---|---|
| 1 | 24 | 'vessel.' should read --vessel."-- |
| 1 | 44 | 'maJor' should read --major-- |
| 4 | 23 | 'mine.' should read --mine,-- |
| 4 | 24 | 'square.' should read --square,-- |
| 6 | 1 | 'lwoer' should read --lower-- |
| 6 | 15 | 'fo' should read --of-- |
| 7 | Between lines 57 and 58 | A heading introducing a new topic has been omitted. The heading should read: BEST MODE FOR CARRYING OUT THE INVENTION |

UNITED STATES PATENT AND TRADEMARK OFFICE

CERTIFICATE OF CORRECTION

PATENT NO. : 5,024,487

DATED : June 18, 1991

INVENTOR(S) : Henry J. Woestemeyer and Martha Oksuz

It is certified that error appears in the above-identified patent and that said Letters Patent is hereby corrected as shown below:

| Column | Line | |
|---|---|---|
| 9 | 26 | 'minecavity' should read --mine-cavity-- |

Signed and Sealed this

Twentieth Day of October, 1992

*Attest:*

DOUGLAS B. COMER

*Attesting Officer*

*Acting Commissioner of Patents and Trademarks*